US011027325B2

(12) United States Patent
Kettler et al.

(10) Patent No.: US 11,027,325 B2
(45) Date of Patent: Jun. 8, 2021

(54) HOT-FORMED METAL SHEET AND METHOD OF PRODUCING AN OPENING IN SUCH A METAL SHEET

(71) Applicant: Benteler Automobiltechnik GmbH, Paderborn (DE)

(72) Inventors: Markus Kettler, Paderborn (DE); Georg Frost, Steinheim (DE); Frank Rabe, Hiddenhausen (DE); Karsten Bake, Delbrück (DE)

(73) Assignee: Benteler Automobiltechnik GmbH, Paderborn (DE)

( * ) Notice: Subject to any disclaimer, the term of this patent is extended or adjusted under 35 U.S.C. 154(b) by 145 days.

(21) Appl. No.: 15/851,297

(22) Filed: Dec. 21, 2017

(65) Prior Publication Data

US 2018/0178268 A1 Jun. 28, 2018

(30) Foreign Application Priority Data

Dec. 22, 2016 (DE) ..... 10 2016 125 510.6

(51) Int. Cl.

| | |
|---|---|
| ***B21D 28/26*** | (2006.01) |
| ***B21D 28/16*** | (2006.01) |
| ***B21D 22/20*** | (2006.01) |
| ***B21D 53/88*** | (2006.01) |
| *C21D 1/673* | (2006.01) |

(52) U.S. Cl.

CPC ..... *B21D 28/26* (2013.01); *B21D 28/16* (2013.01); *B21D 22/208* (2013.01); *B21D 53/88* (2013.01); *C21D 1/673* (2013.01); *C21D 2261/00* (2013.01)

(58) Field of Classification Search

CPC ..... B21D 28/24; B21D 28/26; B21D 28/16; B21D 28/007; B21D 22/208; B21D 53/88

See application file for complete search history.

(56) References Cited

U.S. PATENT DOCUMENTS

| | | | | |
|---|---|---|---|---|
| 8,028,559 | B2 * | 10/2011 | Toeniskoetter | B21D 39/021 29/243.58 |
| 8,389,127 | B2 | 3/2013 | Kettler | |
| 8,678,815 | B2 | 3/2014 | Frost | |
| 2010/0071674 | A1 | 3/2010 | Rabe et al. | |
| 2011/0006559 | A1 | 1/2011 | Schäfers et al. | |
| 2011/0291431 | A1 | 12/2011 | Buschsieweke et al. | |
| 2012/0060982 | A1 * | 3/2012 | Bohner | B21D 22/022 72/364 |
| 2013/0027833 | A1 | 1/2013 | Rabe et al. | |
| 2013/0136945 | A1 * | 5/2013 | Charest | B21D 22/022 428/610 |
| 2013/0220049 | A1 | 8/2013 | Werner et al. | |
| 2014/0224388 | A1 | 8/2014 | Frost et al. | |
| 2015/0273559 | A1 * | 10/2015 | Saito | B21D 35/001 72/275 |
| 2015/0336151 | A1 | 11/2015 | Frost et al. | |
| 2016/0059295 | A1 | 3/2016 | Frost | |
| 2016/0151825 | A1 * | 6/2016 | Bartig | B21J 15/025 29/243.5 |
| 2016/0325338 | A1 | 11/2016 | Rixen et al. | |

FOREIGN PATENT DOCUMENTS

| | | | | |
|---|---|---|---|---|
| CN | 101107086 | A | 1/2008 | |
| CN | 101607289 | A | 12/2009 | |
| CN | 101862785 | A | 10/2010 | |
| CN | 104923613 | A | 9/2015 | |
| CN | 107234164 | A | 10/2017 | |
| DE | 102010007955 | | 8/2011 | |
| DE | 102013017243 | A1 | 4/2015 | |
| DE | 102014000299 | | 7/2015 | |
| DE | 102014002903 | | 8/2015 | |
| JP | 2008081788 | A * | 4/2008 | |
| WO | WO-2016103682 | A1 * | 6/2016 | B21D 22/20 |

OTHER PUBLICATIONS

Machine translation of DE102013017243, Barthel, pp. 1-19, translated on Jun. 10, 2019 (Year: 2019).*

Machine translation of WO 2016103682 A1, pp. 1-24, translation retrieved on Feb. 27, 2020. (Year: 2020).*

Chinese Search Report dated Nov. 22, 2018 with respect to counterpart Chinese patent application 2017113994409.

Translation of Chinese Search Report dated Nov. 22, 2018 with respect to counterpart Chinese patent application 2017113994409.

Chinese Search Report dated Jul. 2, 2019 with respect to counterpart Chinese patent application 2017113994409.

Translation of Chinese Search Report dated Jul. 2, 2019 with respect to counterpart Chinese patent application 2017113994409.

* cited by examiner

*Primary Examiner* — Teresa M Ekiert

(74) *Attorney, Agent, or Firm* — Henry M. Feiereisen LLC

(57) ABSTRACT

A hot-formed metal sheet has a tensile strength Rm>1300 megapascal (MPa) and includes an opening which is produced by high-speed punching at a speed of a punch of more than 6 m/s in the absence of a counter holder of a contour matching a contour of the punch, with a smooth cut proportion of the cutting surface of the opening amounting to more than 50%.

5 Claims, No Drawings

HOT-FORMED METAL SHEET AND METHOD OF PRODUCING AN OPENING IN SUCH A METAL SHEET

CROSS-REFERENCES TO RELATED APPLICATIONS

This application claims the priority of German Patent Application, Serial No. 10 2016 125 510.6, filed Dec. 22, 2016, pursuant to 35 U.S.C. 119(a)-(d), the disclosure of which is incorporated herein by reference in its entirety as if fully set forth herein.

BACKGROUND OF THE INVENTION

The present invention relates to a hot-formed metal sheet, and to a method of producing an opening in such a metal sheet.

The following discussion of related art is provided to assist the reader in understanding the advantages of the invention, and is not to be construed as an admission that this related art is prior art to this invention.

Openings in metal sheets with tensile strengths Rm of above 1,300 MPa are generally produced by using a shear cutting process that typically operate at shear speeds of less than 1 m/s. This process causes, however, microcracks around the hole perimeter. Tests have shown that most microcracks have a length of above 50 μm. In addition, burrs are formed during manufacture with a length of above 40 μm. Burr formation is hereby dependent on material properties, cutting speed, and cutting geometry. A further drawback of shear cutting is the encountered widening of the opening in the region of the breakage, with the widening typically amounting to greater than 10% of the wall thickness. A further downside of shear cutting is the increase in strain hardening, causing hardening of above 15% of the base hardness in the cutting region and breakage area. Edge hardening could be determined up to a depth of about 100 μm. Shear cutting also requires the use of a die as counter holder. In other words, there is a need for a device to receive the die and to configure the device with dimensions that are sufficient to withstand the forces encountered during perforation. The die is normally configured for a particular workpiece and configured to match the desired opening geometry.

It would therefore be desirable and advantageous to address prior art shortcomings.

SUMMARY OF THE INVENTION

According to one aspect of the present invention, a hot-formed metal sheet having a tensile strength Rm>1300 megapascal (MPa) includes an opening produced by high-speed punching at a speed of a punch of more than 6 m/s in the absence of a counter holder of a contour matching a contour of the punch, with a smooth cut proportion of the cutting surface of the opening amounting to more than 50%.

In accordance with the present invention, the punch is operated at a speed at a level sufficient to eliminate the need for a particular die with a contour to match the contour of the punch or to match the contour of the opening to be produced. As a result, there is also no need for a particular device for such a die. The production of the opening can now be realized in a much simpler manner and in addition can be combined with a robotic arm. The overall manufacturing process thus becomes efficient and easier to implement.

In accordance with the present invention, the opening is created by a high-speed punching process at a speed of the punch of more than 6 m/s. This speed is established at least at the time when the punch penetrates the metal sheet.

Advantageously, the punch is situated in a starting position prior to punching at a defined distance to the metal sheet. The distance may hereby be used for accelerating the punch to the desired speed when impacting and penetrating the metal sheet. The high speed of the punch may be realized, e.g. with the aid of magnetic pulse, or pyrotechnical means, or electromagnetic pulse technique. The speed of the punch at more than 6 m/s causes in the workpiece a momentary temperature rise which, however, is limited to a very narrow workpiece zone. As a result, the presence of strain hardening is avoided or at least minimized so that the risk of microcracks is also effectively eliminated.

Heat caused by the punching process does not adversely affect surrounding regions because the very short process times prevent heat to migrate to those surrounding regions. Thus, the area of the separation gap melts locally and becomes softer.

According to another feature of the present invention, the speed of the punch at least at the moment of penetration into the metal sheet can be above 8 m/s or also above 10 m/s. Currently preferred is a speed of the punch of above 20 m/s. Even higher speeds of the punch of e.g. 100 m/s are possible, although the device becomes much more complex. For that reason, an upper limit of 100 m/s punch speed is currently considered appropriate to maintain a compact size of the device.

According to another feature of the present invention, the punch penetration depth can amount to at least 20%, advantageously to at least 50% of the wall thickness of the metal sheet. Currently preferred is a punch penetration depth of not more than 80% of the wall thickness. The smooth cut proportion of the cutting surface of the created opening in the metal sheet can be above 50%, advantageously above 70%. A highest possible smooth cut proportion is generally desired.

According to another feature of the present invention, the metal sheet can be made of high-strength steel which underwent press hardening before producing the opening. As a result, there is no need for the metal sheet to be softened or to precut.

According to another feature of the present invention, the metal sheet can be made of a metallic material selected from the group consisting of non-coated manganese-boron steel, surface decarburized steel, cladded steel, Al/Si-coated manganese-boron steel, and/or zinc-coated manganese-boron steel.

According to another feature of the present invention, the metal sheet may involve a shell-shaped vehicle structure selected from the group consisting of B pillar, inside reinforcement of the B pillar, C pillar, inside reinforcement of the C pillar, A pillar, inside reinforcement of the A pillar, door impact carrier, bumper crossbeam, side rail, sill, tunnel, floor crossbeam, and end wall.

According to another aspect of the present invention, a method includes producing an opening with closed or open cutting line in a hot formed and press hardened metal sheet by high-speed punching at a speed of a punch of more than 6 m/s in the absence of a counter holder of a contour matching a contour of the punch.

According to another feature of the present invention, the punch can be operated to penetrate at least 20% of a wall thickness of the metal sheet into the metal sheet. Currently preferred is a penetration depth of at least 50% of the wall thickness. A smooth cutting proportion of the cutting line of the opening can be realized of above 50% and even above 70%.

In a method according to the present invention, the pulse introduced into the metal sheet plays a relevant role. The kinematic energy of the punch is proportional to the square of the speed of the punch. Thus, even a relatively lightweight punch can be used to generate a strong pulse at high speeds.

According to another feature of the present invention, the speed of the punch can be less than 100 m/s and greater than 10 m/s or greater than 20 m/s. The term "speed" is hereby to be understood in particular as the impact speed of the punch. After the impact, the impact speed is reduced rapidly and in dependence on the penetration depth and the punch mass. An opening with closed cutting line can be referred to as "hole", whereas an opening with open cutting line may include a border-side recess in the metal sheet and thus represent a trim.

According to another feature of the present invention, the punch can be mounted to a robotic arm for movement of the punch into a work position in relation to the metal sheet. The device for the production of the opening becomes much lighter as a result of the elimination of a counter holder. While the device is devoid of a counter holder in the area of the contour being created in the metal sheet, the metal sheet itself is held by an abutment which may be a further robotic arm to fix the metal sheet in place in relation to the punch in the work position. The robotic arm can also be used to remove the metal sheet after being worked on and provided with the opening from the punch.

According to another feature of the present invention, the opening can be produced following or during a removal of the metal sheet from a press-hardening tool. The opening is not being created in the press-hardening tool, i.e. not in the closed press-hardening tool. Machining the metal sheet during removal from the press-hardening tool or directly after the removal from the press-hardening tool enables also manipulations on the metal sheet during transfer times. Cycle times may hereby range to below 20 seconds, advantageously below 12 second. Currently preferred is a cycle time of less than 8 seconds.

According to another feature of the present invention, the opening can be created by mounting the punch to a linear conveyor, marker, or local descaling station. These facilities are normally not intended to produce openings during manipulation or machining of the metal sheet. Because of the absence of a counter holder, it becomes also possible to produce openings in the metal sheet through the high-speed punching process, while the metal sheet is transported on the linear conveyor, or during marking, or even during local descaling, in particular when a metal sheet of stainless steel plated manganese-boron steel is involved.

According to another feature of the present invention, the opening can be produced in a single-step process in the absence of a preceding profiling of a later cutting area through hot forming and/or cold forming or in the absence of a pre-cutting or trimming. The opening can thus be created in one operating step, while the metal sheet can stay flat in the course of the cutting contour.

BRIEF DESCRIPTION OF THE DRAWING

NONE

DETAILED DESCRIPTION OF PREFERRED EMBODIMENTS

NONE

While the invention has been illustrated and described in connection with currently preferred embodiments described in detail, it is not intended to be limited to the details described since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

What is claimed is:

1. A method, comprising:

hot forming and press hardening a metal sheet in a press-hardening tool to a tensile strength of Rm >1300 megapascal (MPa); and producing an opening with closed cutting line in the hot formed and press hardened metal sheet at the tensile strength Rm solely by high-speed punching the metal sheet in a single-step process with a punch at a speed of the punch of more than 6 m/s, sufficient to cause a momentary temperature rise in immediate proximity of the opening to at least minimize strain hardening and wherein the producing step is performed without the use of a counter holder.

2. The method of claim 1, wherein the speed of the punch is less than 100 m/s and greater than 10 m/s.

3. The method of claim 1, wherein the speed of the punch is less than 100 m/s and greater than 20 m/s.

4. The method of claim 1, further comprising mounting the punch to a robotic arm for movement of the punch into a work position in relation to the metal sheet.

5. The method of claim 4, further comprising securing the metal sheet to the robotic arm or to a further robotic arm in relation to the punch in the work position.

* * * * *